US009527553B2

(12) United States Patent
White et al.

(10) Patent No.: US 9,527,553 B2
(45) Date of Patent: Dec. 27, 2016

(54) ROPE CLEATING SYSTEM

(71) Applicant: Vitalz Outdoors, LLC, Georgetown, TX (US)

(72) Inventors: Russell W. White, Austin, TX (US); Stanley M. Dufek, Costa Mesa, CA (US)

(73) Assignee: Vitalz Outdoors, LLC, Georgetown, TX (US)

( * ) Notice: Subject to any disclaimer, the term of this patent is extended or adjusted under 35 U.S.C. 154(b) by 0 days.

(21) Appl. No.: 15/006,203

(22) Filed: Jan. 26, 2016

(65) Prior Publication Data

US 2016/0137265 A1 May 19, 2016

Related U.S. Application Data

(63) Continuation of application No. 14/672,470, filed on Mar. 30, 2015, now Pat. No. 9,266,584.

(60) Provisional application No. 61/974,254, filed on Apr. 2, 2014.

(51) Int. Cl.
*B63B 21/04* (2006.01)

(52) U.S. Cl.
CPC ..... *B63B 21/04* (2013.01)

(58) Field of Classification Search
CPC ..... B63B 21/04; B63B 21/08; F16N 13/02
USPC ..... 114/218
See application file for complete search history.

(56) References Cited

U.S. PATENT DOCUMENTS

| | | | | |
|---|---|---|---|---|
| D947,111 | | 1/1910 | Lorentz | |
| 3,857,645 | A | 12/1974 | Klein | |
| 4,414,712 | A | 11/1983 | Beggins | |
| 4,477,948 | A | 10/1984 | Sachs | |
| 4,479,454 | A | 10/1984 | Schepel | |
| 4,685,500 | A | 8/1987 | Silvia | |
| 4,930,193 | A | 6/1990 | Baker | |
| 4,989,531 | A | 2/1991 | Humphrey | |
| 5,014,459 | A | 5/1991 | Sublet | |
| 5,826,531 | A | 10/1998 | Havnaer, Jr. | |
| 6,223,670 | B1 | 5/2001 | Schulze | |
| 6,557,217 | B2 | 5/2003 | Szabo | |
| 6,581,250 | B2 | 6/2003 | Matsushima | |
| 9,266,584 | B2 * | 2/2016 | White | B63B 21/04 |

* cited by examiner

*Primary Examiner* — Stephen Avila

(57) ABSTRACT

A system for rope cleating is disclosed. A system incorporating teachings of the present disclosure may include a cleating component, an anchoring component, and an exterior shell. In practice, the system may facilitate connecting a boat to a dock even if the boater is unfamiliar with proper nautical knots.

10 Claims, 3 Drawing Sheets

ROPE CLEATING SYSTEM

This application is a continuation of U.S. patent application Ser. No. 14/672,470, filed Mar. 30, 2015, which claims priority to U.S. Provisional Patent Application Ser. No. 61/974,254 filed on Apr. 2, 2014 in the name of Russell W. White and Stanley M. Dufek entitled ROPE CLEATING SYSTEM, the content of which is hereby incorporated by reference.

TECHNICAL FIELD

The following disclosure relates to rope cleats, and more particularly to a rope cleating system.

BACKGROUND

Generally speaking, rope cleats facilitate the securing of a rope to or around an object. Often, a cleat is attached to a dock, and a person ties a rope that is connected to a boat around the cleat. One example is a double horn cleat to which a person typically ties a cleat hitch knot. However, many boaters do not know how to tie proper knots like the cleat hitch knot.

DETAILED DESCRIPTION

Figure 3A:
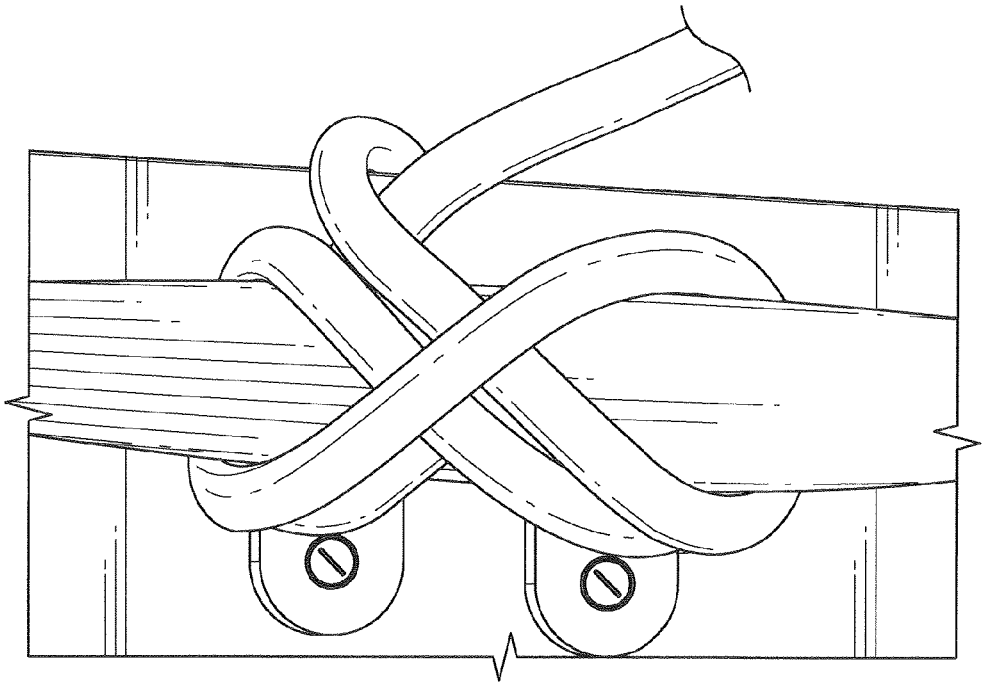
FIG. 3A illustrates a traditional double horned cleat with a rope secured using a cleat hitch knot.
Figure 3B:
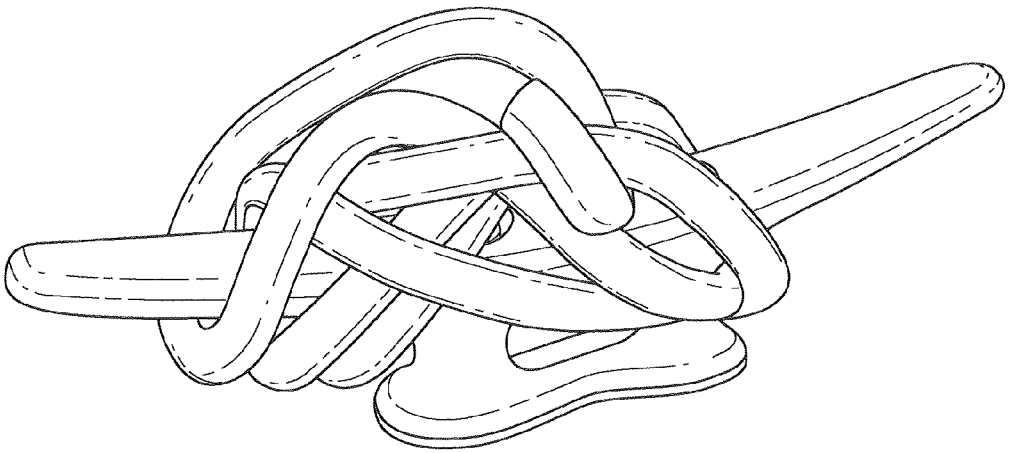
FIG. 3B illustrates a traditional double horned cleat with a rope secured using an arbitrary knot that will not remain secure.

As mentioned above, a rope cleat can be used to facilitate the securing of a rope to or around an object. One type of cleat, the double horned cleat, can often be found on boat docks. In many cases, the cleat is bolted or screwed to a wooden dock and made available to docking boats. In such a circumstance, the docking boat may have a rope tied to some portion of the boat. The end of the rope that is not tied to the boat may be used to tether the boat to the dock by wrapping the rope around the double horned cleat. As shown in FIGS. 3A and 3B, there can be significant differences in the type of knot used to tie off to the cleat. FIG. 3A illustrates a traditional double horned cleat with a rope secured using a cleat hitch knot. The knot depicted in FIG. 3A is an effective knot and should keep a tethered boat securely connected to the dock. FIG. 3B illustrates a traditional double horned cleat with a rope secured using an arbitrary knot that will not remain secure.

Figure 1:
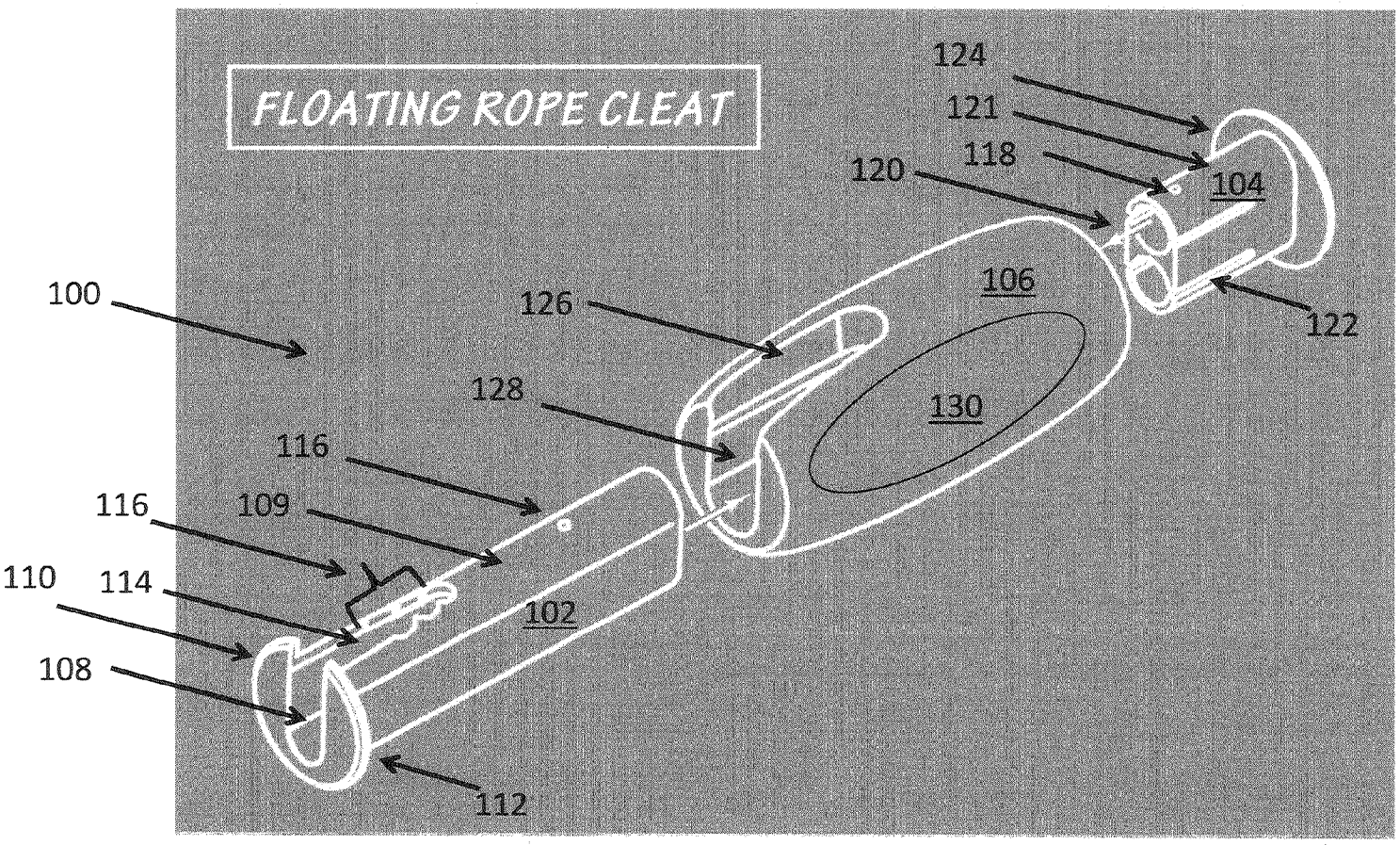
FIG. 1 illustrates an exploded view of a rope cleating system that incorporates teachings of the present disclosure for improved performance.

Many boaters lack the knot tying expertise necessary to safely secure a boat to an available double horned cleat. The cleating systems depicted in FIGS. 1 and 2, in addition to other potential benefits, could help these boaters to safely secure their boats to available docks. As mentioned above, FIG. 1 illustrates an exploded view of a rope cleating system 100 that incorporates teachings of the present disclosure for improved performance. As shown, system 100 includes a cleating sleeve 102, an anchoring sleeve 104, and a floating shell 106. Though system 100 is depicted in an exploded manner, one skilled in the art will recognize how system 100 may be connected into a unit. Moreover, one skilled in the art will recognize that the three-piece system could also be manufactured as a one-piece or a two-piece system. Similarly, a designer may elect to utilize a system with more than three pieces.

As shown, cleating sleeve 102 defines a generally elliptical opening 108 through which a rope may be doubled back upon itself. Cleating sleeve 102 also includes a member 109 and an end cap 110 that defines a shoulder 112 that may serve to help keep floating shell 106 in position when cleating sleeve 102 and anchoring sleeve 104 are connected. Cleating sleeve also includes a cleat opening 114 that defines three cleating locations indicated generally at 116. In practice, a rope may pass through elliptical opening 108 (along the bottom of the opening), around anchoring sleeve 104 (as defined more fully below) and back through elliptical opening 108 (this time above the earlier passed rope). The tag end of the rope routed in such a way may then be pulled into cleat opening 114 and removably locked in place.

Cleating sleeve 102 also includes locking port 116, which may interact with locking node 118 to help secure cleating sleeve 102 to anchoring sleeve 104. In some instances, locking port 116 and locking node 118 may releasably connect sleeves 102 and 104. For example, a designer may offer system 100 as a kit with more than one anchoring sleeves like sleeve 104. Each of the sleeves included in such a kit may be sized for use with different diameters of rope. If a boater is using ⅜ inch rope, the boater may use an anchoring sleeve designed for ⅜ to ½ inch rope (for example). If the boater is using ⅝ inch rope, the boater may upsize to an anchoring sleeve designed for ropes larger than ½ inch.

As shown, anchoring sleeve 104 includes a dual port system 120, which may allow for a separation of the rope as it passes into and out of anchoring sleeve 104. Dual port system 120 (as depicted) extends through member 121 and includes deflection slits 122, which facilitate the sliding of anchoring sleeve 104 or at least a portion of sleeve 104 into cleating sleeve 102. In addition, deflection slits 122 may create a spring force that helps lock depicted locking node 118 into locking port 116. Anchoring sleeve 104 may also include an end cap 124 that acts in a manner similar to end cap 110.

As shown, dual port system 120 may include two holes that remain independent from one another and are formed all the way through anchoring sleeve 104. Such a design may keep a rope passed through the bottom hole and then routed back through the top hole from being "pulled through" and accidently removed from system 100. As shown, the holes of anchoring sleeve 104 may be specifically designed for a given diameter of rope. The holes may also be designed with some "slop" to allow for some flexibility in the diameter of rope used. For example, the holes may allow for the sliding through of a rope having a ⅜ inch diameter, a ½ inch diameter, or both.

System 100, as depicted, also includes floating shell 106, which surrounds cleating sleeve 102 and anchoring sleeve 104 when system 100 is snapped together. Though floating shell 106, as depicted, is intended to provide buoyancy and to help system 100 float when in use, a given designer may choose to create floating shell 106 from a material that does not float. As shown, floating shell 106 is intended to float and to provide some give or impact resistance. As such, floating shell 106 may be formed from several different materials. For example, floating shell 106 may be formed from neoprene, sponge, foam, rubber, plastic, some other lightweight material, and/or a combination of materials. Similarly, cleating sleeve 102 and anchoring sleeve 104 may be formed from the same or different materials. In one example version of system 100, cleating sleeve 102 and anchoring sleeve 104 may be formed from an extruded plastic material while floating shell 106 may be formed from a scuba foam, a fabric, a foam, a neoprene, or other high buoyancy material that facilitates screen printing on its exterior surface.

As depicted, floating shell 106 is sized to fit snugly around cleating sleeve 102 and anchoring sleeve 104 and to be held in place by end caps 110 and 124 when cleating sleeve 102 and anchoring sleeve 104 are connected to one another. In addition, floating shell 106 includes cut out 126, which may help a user to pull the tag end of a rope into cleat opening 114 without undue interference from floating shell 106. As shown, the generally elliptical cross section of cleating sleeve 102, anchoring sleeve 104, and the hole 128 formed through floating shell 106 may help to keep cut out 126 in position relative to cleat opening 114. In addition, a designer may elect to include a printable location 130 on shell 106 to facilitate the inclusion of marketing, branding, and/or contact information, some or all of which may be printed and/or reproduced on shell 106.

As indicated above, system 100 incorporates teachings of the present disclosure and represents one way a designer may choose to implement some teachings. Many things could be altered if a designer so chooses without departing from the present teachings. As mentioned above, the number of component parts within system 100 may be changed. Similarly, different materials may be chosen. Components of a system like system 100 may include, for example, one or more of a plastic material, a rubber material, a spandex material, a leather material, a neoprene material, a metal material, a wooden material, a woven material, and/or some other material that is suitable for performing the objectives of system 100.

Figure 2:
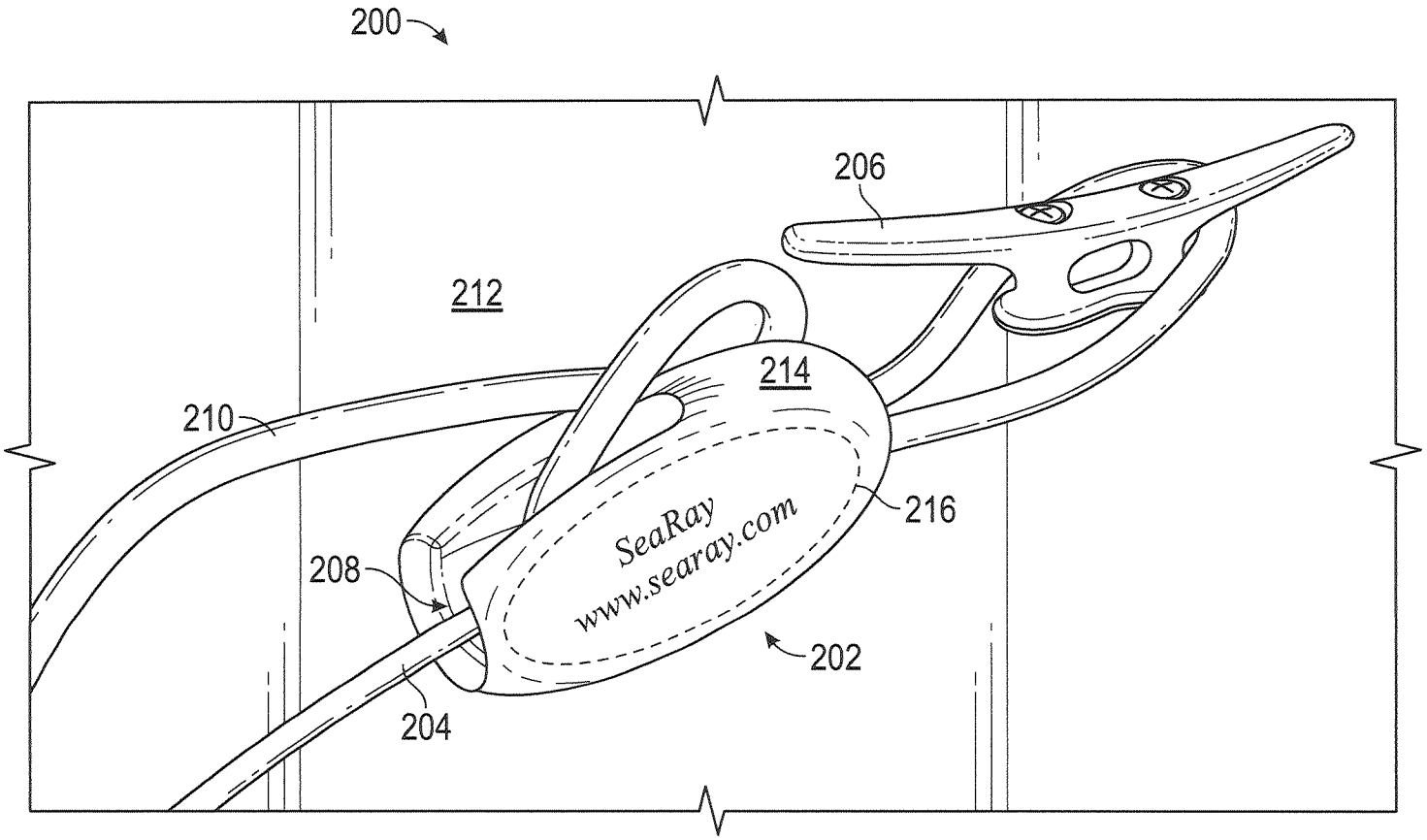
FIG. 2 depicts a photographic style image that depicts use of a rope cleating system that incorporates teachings of the present disclosure.

As indicated above, FIG. 2 depicts a photographic style image of a rope cleating solution 200 that incorporates teachings of the present disclosure. As shown, a system 202, which may be like system 100, is shown in an assembled state. In addition, a rope 204 is shown as passing through system 202 around double horned cleat 206 and back through system 202. Rope 204, as depicted, has been seated into a cleating mechanism 208, which may be similar to cleat opening 114. The tag end 210 of rope 204 is shown as resting on a wooden dock 212 to which double horned cleat 206 is attached.

System 202 also depicts an outer shell 214, which may be similar to floating shell 106. As shown, outer shell 214 presents a printable surface 216 onto which the words "SeaRay" and "www.searay.com" are printed. The printing technique may include, for example, silk screen printing, embossing, branding, labeling, stamping, embroidering, etc., and/or some combination of these or other techniques. As shown, printable surface 216 may made from a material and offered in a size and shape that facilitates the inclusion of branding, marketing, and/or contact information, among other things.

In one offering, a system, like system 202, may work with various standard rope diameters, may be made of some combination of soft, durable, and/or floating materials, and may provide a surface to add marketing and contact information. Such a system may, for example, help boaters who tie knots like the one depicted in FIG. 3B to safely and securely tether their boats to docks with double horned cleats.

A system incorporating teachings of the present disclosure may replace, add, or delete many of the above-described features and components without departing from the scope of the disclosure. One skilled in the art will recognize that the many of the above-described components could be combined or broken out into other combinations.

Although the present invention has been described in detail, it should be understood that various changes, substitutions and alterations to the devices, methods, and other aspects and techniques of the present invention can be made without departing from the spirit and scope of the invention as defined by the appended claims.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A system comprising:

a cleating component at least partially defining a generally elliptical void formed along its longitudinal axis;

an anchoring component at least partially defining a first and second generally circular void;

a cleat opening having at least one cleating location, wherein a rope passed through the elliptical void, and through the first generally circular void, and back through the second generally circular void can be removably lodged within the at least one cleating location; and a floating component.

2. The system of claim 1, wherein the cleating component and the anchoring component are two distinct pieces configured to connect to one another.

3. The system of claim 2, wherein the cleat opening is formed into the cleating component.

4. The system of claim 3, wherein the floating component is a third distinct piece formed to slide over at least one of the cleating component and the anchoring component.

5. The system of claim 1, wherein the anchoring component is made of a plastic material and formed such that at least a portion of the plastic material isolates the first and second generally circular voids from one another.

6. A rope tie off system, comprising:

a cleating component made from an injection moldable material and formed to at least partially define a void formed along its longitudinal axis;

an anchoring component made from the injection moldable material and formed to at least partially define a first void having a generally circular cross section and second void having a generally circular cross section, wherein the two voids are parallel to one another and isolated from one another;

a cleat opening in the cleating component having at least one cleating location, wherein a rope passed through the void, and through the first void, and back through the second void can be removably lodged within the at least one cleating location; and a floating component at least partially surrounding the cleating component.

7. The system of claim 6, wherein the cleating component and the anchoring component are two distinct pieces configured to releasably connect to one another.

8. The system of claim 7, wherein cleating component is formed to at least partially define another void formed along its longitudinal axis, wherein the void and the another void have generally circular cross sections that align with the first void and the second void of the anchoring component when the cleating component and the anchoring component are releasably connected to one another.

9. The system of claim 7, wherein the floating component is a third distinct piece formed to slide over at least one of the cleating component and the anchoring component.

10. The system of claim 6, wherein the void formed into the cleating component is generally elliptical in cross section and has an area larger than the sum of the area of the first void cross section and the second void cross section.

* * * * *